United States Patent [19]

Fernstrum

[11] 4,338,993

[45] Jul. 13, 1982

[54] UNDERWATER OUTBOARD MARINE HEAT EXCHANGER

[75] Inventor: Paul W. Fernstrum, Menominee, Mich.

[73] Assignee: R. W. Fernstrum & Co., Menominee, Mich.

[21] Appl. No.: 123,888

[22] Filed: Feb. 22, 1980

[51] Int. Cl.[3] ..... B60H 1/04; F28D 7/02

[52] U.S. Cl. ..... 165/44; 165/165; 165/175

[58] Field of Search ..... 165/44, 169, 170, 179, 165/165, 153, 175; 62/519, 524

[56] References Cited

U.S. PATENT DOCUMENTS 2,382,218 8/1945 Fernstrum ..... 165/44

FOREIGN PATENT DOCUMENTS 2259343 8/1975 France ..... 165/165

*Primary Examiner*—Albert W. Davis
*Assistant Examiner*—Margaret A. Focarino
*Attorney, Agent, or Firm*—Barnes, Kisselle, Raisch & Choate

[57] ABSTRACT

A first water header is connected to a second water header by laterally-spaced multiple parallel composite tubes, each consisting of two or more component tubes of vertically-elongated rectangular cross-section welded to one another along their horizontal narrower adjoining faces, the height of each component tube being a multiplicity of times the width thereof. The thus welded faces form intermediate partitions or webs of doubled thickness running the entire length of the composite tube. This greatly strengthens the composite tube thus obtained and also divides the cooling water flow into vertically-spaced thin streams or bands of cooling liquid. Rising from the first and second headers are first and second fittings which serve not only to transmit the cooling water into and out of their respective headers but also serve to connect and attach the header to the keel or other underwater location of the heat exchanger to the hull of the boat or vessel. One or more intermediate supports are secured transversely to the upper faces of the conduit and have threaded stems which also pass upward through the keel or other underwater part of the hull to which the heat exchanger is attached.

1 Claim, 5 Drawing Figures

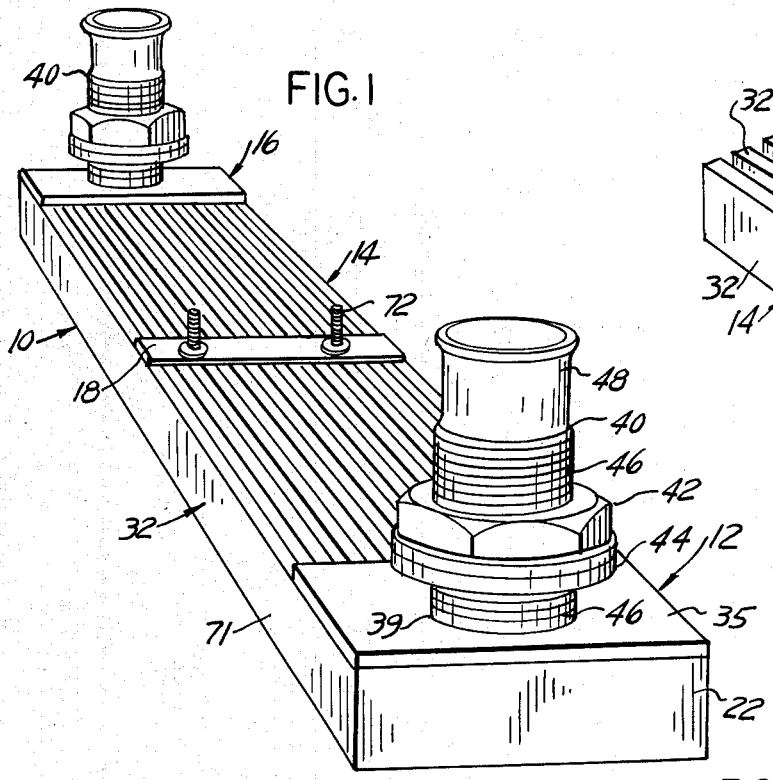
FIG. 1
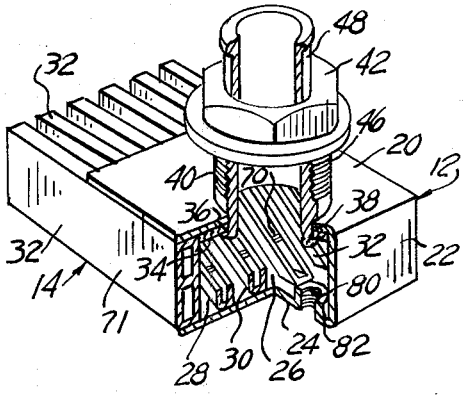
FIG. 2
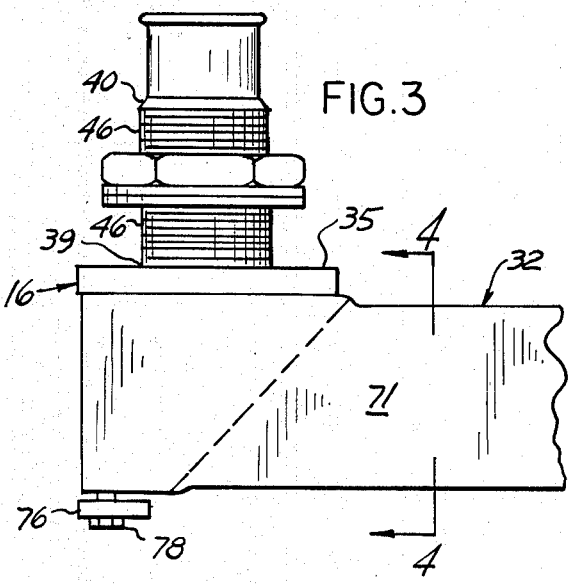
FIG. 3
FIG. 5
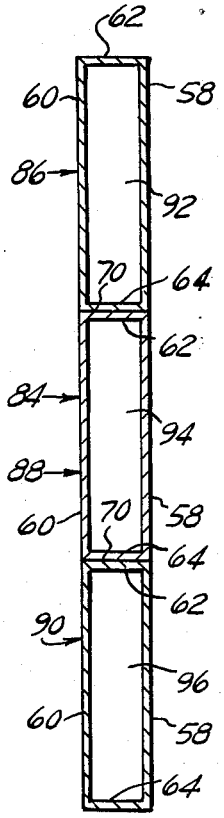
FIG. 4
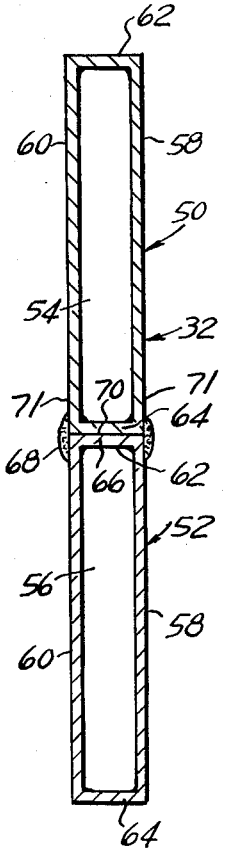

UNDERWATER OUTBOARD MARINE HEAT EXCHANGER

BACKGROUND OF THE INVENTION

An outboard marine heat exchanger made in accordance with the thus-entitled Fernstrum U.S. Pat. No. 2,382,218 issued Aug. 14, 1945 has for many years successfully solved the cooling problems of marine engines of moderate size and power. More recently, however, such heat exchangers made in accordance with the Fernstrum patent have proved to be inadequate for large engines of high power. Attempts to produce the component thin rectangular hollow tubes have proved unsuccessful because of the inability, under the present state of the extruding art, to extrude tubes of rectangular cross-section from copper or copper alloys wherein the vertical dimension exceeds the horizontal dimension by a ratio of more than three to one, such factors in such tubes of up to five-to-one ratio resulting in a high percentage of defective and therefore wasted tubes. The present invention enables production of composite tubes of rectangular cross-section wherein the ratio of the height to the width can be ten times or more, the welded-together intermediate walls forming a doubly-thick partition or web which serves as a backbone to greatly strengthen the composite tube and to prevent collapse thereof under the pressure of water passing through the tubes.

SUMMARY OF THE INVENTION

The invention principally resides in the provision of composite tubes of rectangular cross-section interconnecting the first and second headers, the composite tubes consisting of a plurality of component tubes of vertically-elongated rectangular cross-section with their narrower horizontal walls welded to one another along their adjoining flat faces.

In the drawing,

FIG. 1 is a perspective view of an improved underwater outboard marine heat exchanger, according to a preferred form of the invention;

FIG. 2 is a perspective view of one of the headers and adjoining ends of the cooling tubes, partly broken away at one corner to show in section the internal construction of the headers and with the sealing gasket at the top omitted to avoid concealing the structure beneath it;

FIG. 3 is a side elevation, upon an enlarged scale, of one of the headers and the adjoining portion of the cooling tube;

FIG. 4 is a still further enlarged vertical section through one of the composite cooling tubes taken along the line 4—4 in FIG. 3; and FIG. 5 is a view similar to FIG. 4, but showing a modification wherein the composite cooling tube is made up of three vertically-stacked inter-welded component tubes.

Referring to the drawing in detail, FIG. 1 shows an underwater outboard marine heat exchanger, generally designated 10, as consisting generally of a first header 12 connected by a heat exchange composite tube assembly 14 fo a second header 16, the composite tube assembly 14 being strengthened and additionally supported by one or more cross bars 18 welded or otherwise secured to the composite tube assembly 14 at an intermediate location between the headers 12 and 16. Each of the headers 12 and 16 includes a wide horizontal top plate 20, a vertical end plate 22 (FIG. 2), a narrow horizontal bottom plate 24 and an inclined bottom plate 26 welded at its upper end to the underside of the top plate 20. The inclined bottom plate 26 contains spaced parallel slots 28 through which project the inclined ends 30 of the composite tubes 32 of which the complete tube assembly 14 is made up. Welded beneath the top plate 20 is a nipple plate 34. A gasket 35 (omitted in FIG. 2) is mounted on the top plate 20. The nipple plate 34, top plate 20 and gasket 35 are bored centrally in alignment at 36, 38 and 39 respectively to receive the lower end of a fitting comprising a threaded vertical nipple 40 secured therein. A nut 42 and washer 44 are mounted on the nipple 40, the internal threads of the nut 42 threadedly engaging the threads 46 of the nipple 40, the upper end portion 48 of which is slightly reduced in diameter externally and smooth to receive conduits, such as hoses, leading to the water jacket connections or couplings of the engine to be cooled by the outboard marine heat exchanger 10, in the manner described below in connection with the operation of the invention.

Each composite tube 32 (FIG. 4) is made up of two or more vertically-stacked component tubes 50 and 52 respectively enclosing elongated vertically thin flow chambers or passageways 54 and 56 respectively. Each of the component tubes 50 and 52 is made up of parallel vertical side walls 58 and 60 which are approximately five times the width of the top and bottom walls 62 and 64. These proportions of approximately five-to-one represent the maximum ratio employed in this invention for component tubes 50 and 52 made of copper or copper alloy and exceeds the generally accepted maximum permissible ratio of three-to-one by manufacturers of such extruded metallic copper or copper alloy tubes. Since the five-to-one ratio of the present invention represents approximately the maximum permissable one for tubes capable of withstanding the hydraulic pressure of forty-five pounds per square inch prescribed for certain engine cooling systems and since such component tubes 50 and 52 are of individually-insufficient liquid-carrying capability to adequately cool a large internal combustion engine, the duplex or composite tube arrangement 32 shown in FIG. 4 was devised to solve this problem and has satisfactorily done so.

To achieve the construction of the composite tube shown in cross-section in FIG. 4, the narrower horizontal bottom wall 64 of the upper component tube 50 is welded along the plane 66 to the narrower horizontal top wall 62 of the lower component 52 with continuous beads 68, starting the weld from one end of the composite tube 32. The weld 68 is conventionally shown in section in FIG. 4 by the linear bulges or bead 68 along the opposite outer edges of the plane 66 according to mechanical drafting symbol 14 of the United States Patent Office standard drafting symbols. In actual practice, however, this bulge or bead 68 is almost imperceptible, hence is exaggerated at 68 in FIG. 4. The composite tube 32 just described, moreover, provides a double wall thickness at the adjoining single walls 62 and 64 along the linear plane 66, and thus obtains, in addition, a strong linear internal composite strut or web or partition 70 joining together the thus-formed composite side walls 71. This construction considerably strengthens and makes rigid support for the composite tubes 32 of the composite tube assembly 14 and the water flowing through the chambers or passageways 54 and 56 thereof by providing, in effect, a double-thickness "backbone" running down the middle of each composite tube 32.

Additional support and strengthening of the underwater heat exchanger 10 is provided by one or more of the intermediate cross bars 18 which also reduce the vibration set up in the operation of the engine which is cooled by the heat exchanger 10. Welded or otherwise secured to the cross bars 18 are the lower ends of threaded attachment studs 72 (FIG. 1). For saltwater installations, a zinc electrode plate 76 (FIG. 3) is held by bolts 78 below each of the headers 12 and 16. An internally-threaded collar 80 welded to the horizontal bottom plate 24 within a hole 82 therein is adapted to receive a drain plug (not shown) in the header 12.

In the installation of the heat exchanger 10, a recess is preferably provided in the keel of the boat or vessel of a depth sufficient to receive the composite tube assembly 14 flush therewith, longitudinally-spaced holes being bored in the keel of bottom plating to receive and pass the nipples 40 of the headers 12 and 16. At the same time, laterally-spaced holes of smaller diameter are similarly provided for the studs 72 rising from the cross bar or cross bars 18. The requisite nuts and washers are applied to the threads 46 of the various threaded nipples 40 and suitable nuts and washers (not shown) likewise applied to the studs 72 inside the hull of the boat or vessel. Suitable conduits or hose connections (not shown) to the engine cooling system are also applied to the upper end portions 48 of the nipples 40 and the heat exchanger 10 is then ready for use. If, however, it is not feasible to provide such a recess in the keel, a slightly modified header construction with inclined or "streamlined" opposite end walls 22 is provided to reduce the resistance of the heat exchanger 10 as it passes through the water while projecting downward from the keel.

The operation of the invention is believed to be adequately described by the foregoing description of the construction and installation thereof. As the boat or vessel travels through the water and the cooling water heated by the engine flows through the thin vertically-elongated chambers or passageways 54 and 56 (FIG. 4) in the multiple composite tubes 32, the sea water, lake water or river water constituting the body of water through which the boat or vessel is traveling passes between the composite side walls 71 of the composite tubes 32, drawing off the heat conducted through the side walls 58, 60 of the component tubes 50 and 52.

In FIG. 5 there is shown, in cross-section and on a slightly reduced scale from FIG. 4, but otherwise similar, a modified composite tube, generally designated 84. The composite tube 84 is made up of three vertically-stacked component tubes 86, 88 and 90 welded together along the edges of their narrower faces 62 and 64 and thereby providing triple liquid passageways 92, 94 and 96 respectively. The above description pertaining to FIG. 4 similarly applies to the details of FIG. 5, wherein similar parts are designated by the same reference numerals.

The construction described above wherein the header 12 is a liquid inlet header and the header 16 is a liquid outlet header constitutes a single pass heat exchanger. By separating the tube assembly 14 into two separate groups and providing partitions in the header 12, and by omitting the outlet nipple 40 in the header 16 and placing it side-by-side with the similar nipple 40 in the header 12, a double pass heat exchanger can be provided. In a similar manner, a triple pass heat exchanger can be provided by dividing the composite tube assembly 32 into three groups with corresponding partitions in the headers 12 and 16 and by providing a single nipple 40 for the header 16 and two nipples side-by-side for the header 12, a triple pass heat exchanger can be provided.

I claim:

1. An underwater outboard marine heat exchanger for attachment to the outside of a hull of a water going vessel which comprises:

(a) a plurality of component tubes having a rectangular cross-section wherein each of said tubes has a broader wall at least three times the width of its narrower wall, said tubes being stacked vertically in multiples of two or more with the narrower walls adjacent and welded to each other, a multiplicity of said stacked tubes being arranged in parallel relation and spaced from each other to provide longitudinal passages between the components for contact with and flow of water in which a vessel is supported, (b) a header at each end of said tubes comprising cross plates fastened to said tubes to form a manifold chamber open to each of said parallel component tubes and to space said tubes laterally, and (c) a connector fitting rising from each said header in communication with said manifold chamber having a threaded exterior to serve to mechanically fasten said headers to a vessel hull and provide liquid connectors for water flow from within the vessel to said headers and the interior of said component tubes.

* * * * *